US006283363B1

(12) United States Patent
Focke

(10) Patent No.: US 6,283,363 B1
(45) **Date of Patent: *Sep. 4, 2001**

(54) PACKAGE FOR INDIVIDUAL PACKS AND PROCESS AND APPARATUS FOR PRODUCING SAME

(75) Inventor: Heinz Focke, Verden (DE)

(73) Assignee: Focke & Co. (GmbH & Co.), Verden (DE)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/630,903

(22) Filed: Apr. 4, 1996

(30) Foreign Application Priority Data

Apr. 6, 1995 (DE) ..... 195 12 547

(51) Int. Cl.[7] ..... B65D 5/08

(52) U.S. Cl. ..... 229/125.19; 229/125.33; 229/164

(58) Field of Search ..... 229/125.08, 125.19, 229/125.33, 169, 164, 125.34, 125.35, 164.2, 164.1

(56) References Cited

U.S. PATENT DOCUMENTS

| | | | | |
|---|---|---|---|---|
| 2,660,362 | * | 11/1953 | Schilling | 229/125.33 |
| 3,743,167 | | 7/1973 | Russell . | |
| 3,744,700 | | 7/1973 | Stegmann . | |
| 3,810,573 | * | 5/1974 | Russell et al. | 229/125.33 X |
| 3,910,483 | * | 10/1975 | Ritter | 229/125.33 X |
| 4,015,403 | | 4/1977 | Langen | 53/195 |
| 4,308,020 | | 12/1981 | Langen | 493/175 |
| 4,471,870 | | 9/1984 | Uhlig | 206/150 |
| 4,722,474 | * | 2/1988 | Dropsy | 229/169 X |
| 4,860,948 | * | 8/1989 | Hofstede | 229/169 X |

FOREIGN PATENT DOCUMENTS

| | | | |
|---|---|---|---|
| 2519345 | 11/1975 | (DE) . | |
| 3117722 | 2/1982 | (DE) . | |
| 8903904 | 5/1989 | (DE) . | |
| 0266321 | 5/1988 | (EP) . | |
| 429 064 A1 | 11/1990 | (EP) | G03C/3/00 |
| 0607769 | 7/1994 | (EP) . | |
| 0647565-A1 | 4/1995 | (EP) . | |
| 1413603 | 7/1973 | (GB) . | |
| 1461539 | 1/1977 | (GB) . | |
| 1490896 | 11/1977 | (GB) . | |
| 2171975 | 9/1986 | (GB) . | |

* cited by examiner

*Primary Examiner*—Joseph M. Moy
(74) *Attorney, Agent, or Firm*—Abelman, Frayne & Schwab

(57) ABSTRACT

In the production of packages made of relatively rigid packaging material, e.g. cardboard, it is not possible to directly fold the blank around the pack contents, if the pack contents are composed of articles which may not be mechanically strained, as for example, soft packs. A folding sleeve (47) which can be moved together with the pack contents makes it possible to fold a cardboard blank (28) around the pack contents. The folding sleeve (47) surrounding the pack contents absorbs the mechanical strain occurring in the folding process. Before completing the package, the folding sleeve (47) is pulled out of the region of the pack contents.

10 Claims, 10 Drawing Sheets

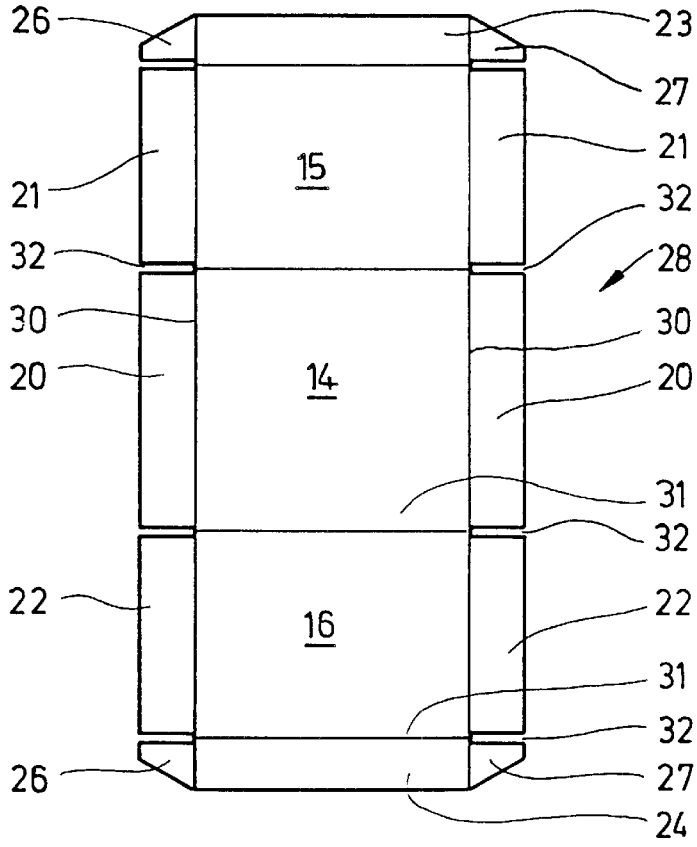
Fig. 1
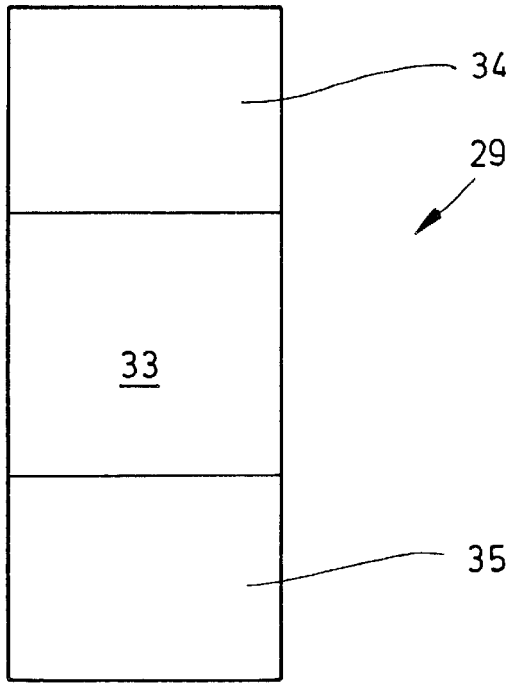

PACKAGE FOR INDIVIDUAL PACKS AND PROCESS AND APPARATUS FOR PRODUCING SAME

The invention relates to a package for particulate goods, especially for a group of (cuboid) individual packs, especially soft packs, comprised of a pack part (main pack/basic pack/carton) and at least one cover for open side faces of the pack part, which consists of thin packaging material, especially paper. The invention furthermore relates to a process and an apparatus for making such packages.

The invention deals with a material-saving package which, in addition to this, simplifies handling. The package is particularly suitable and intended for the accommodation of a group of individual packs. These packs may, in particular, be soft packs, and thus individual packs with a content of articles made of cellulose pulp or cotton wool.

The invention is based on the object to propose a package which has sufficient dimensional stability in spite of a reduced material consumption and, moreover, ensures an easy access to the pack contents, so that the package can also be used as a display for sale.

To attain this object, the package according to the invention is characterized in that the supporting element is U-shaped with a bottom wall and upright, mutually confronting side walls which are confronted by open sides which adjoin one another in a U-shaped manner, the bottom wall and the side walls being provided with connecting members which project into the region of the open sides, namely bottom strips, lateral strips, and transverse strips for fixing a U-shaped cover for the open sides on the outside of the strips by adhesive bonding or the like.

The supporting element made of cardboard or the like forms the dimensionally stable supporting member of the package with a bottom wall and two mutually confronting side walls. These side walls are provided with transversely directed edge strips which extend in the plane of the open side faces and are connected to one another. This results in an additional stabilization of the three-dimensional structure. The flange-like lateral strips furthermore serve for fixing the one-piece blank of the cover on the outside of the edge strips by adhesive bonding.

Consequently, the package according to the invention consists of two blanks. In the production of the package, a cardboard blank for the supporting element is first folded around the pack contents in a U-shaped manner, and then the strips are folded into the plane of the open sides and connected to one another. Afterwards, the cover is also folded around the pack part by a U-shaped folding in the region of the open sides, and connected to the strips.

In the packaging of soft goods, especially soft packs, the pack contents are stabilized during the U-shaped folding of the cardboard blank by guides, especially by a movable folding sleeve which at least partially surrounds the pack contents and ensures the dimensional stability of the pack contents during the U-shaped folding of the cardboard blank. The folding sleeve is pulled out of the partly folded package after the U-shaped folding of the cardboard blank or after erecting the side walls.

In a separate folding cycle, the paper blank for forming the cover is folded over the supporting element and the pack contents in a U-shaped manner, specifically in the course of an upward movement of the supporting element.

The apparatus according to the invention for producing a package comprises a folding station for the cardboard blank and a further folding station for the cover. In the first-mentioned folding station, the pack contents with the blank are first moved downwards to carry out first folding steps and then horizontally to complete the folding of the supporting element. The cover is then laid against the supporting element by an upward movement of the partly finished package. The ready package may then be situated at feed level.

In the following, an exemplary embodiment of the package and the apparatus for making same using the process according to the invention will be explained with reference to the drawings.

In these:

FIG. 1 shows two spread-out blanks for a package,

Figure 2:
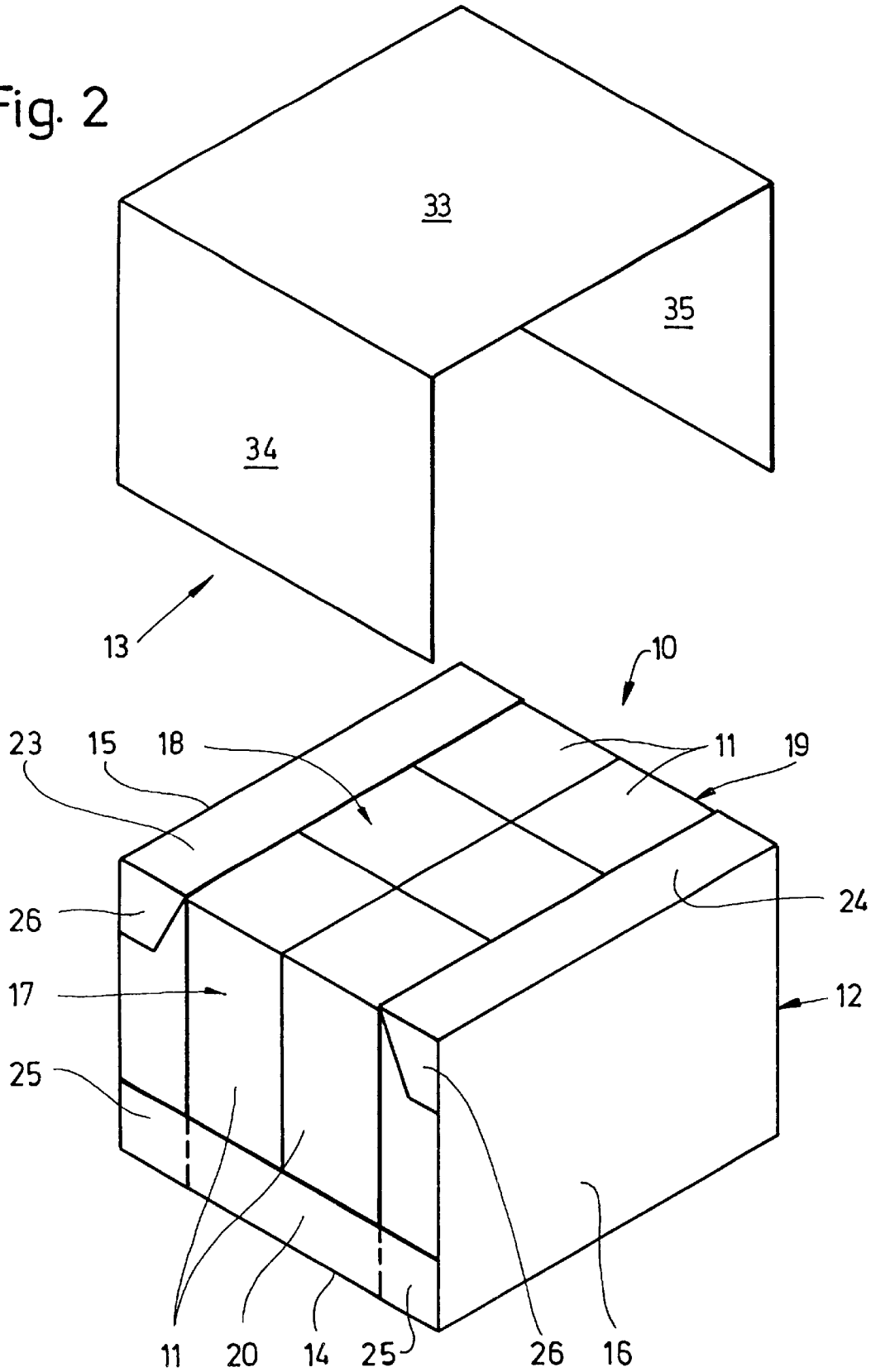
FIG. 2 shows a perspective view of the partly ready-folded package.
Figure 3:
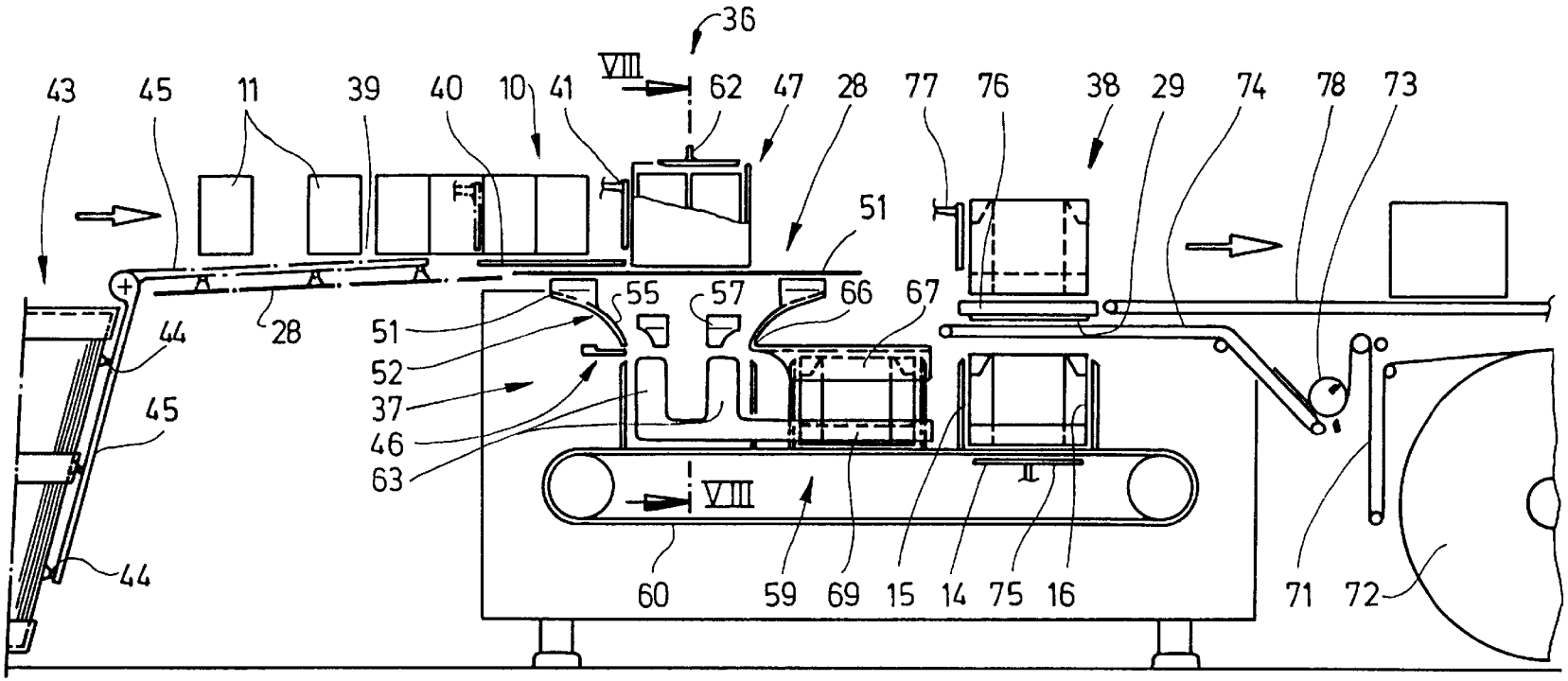

FIG. 3 a diagrammatic side view of an apparatus for producing packages according to FIG. 2.

Figure 4:
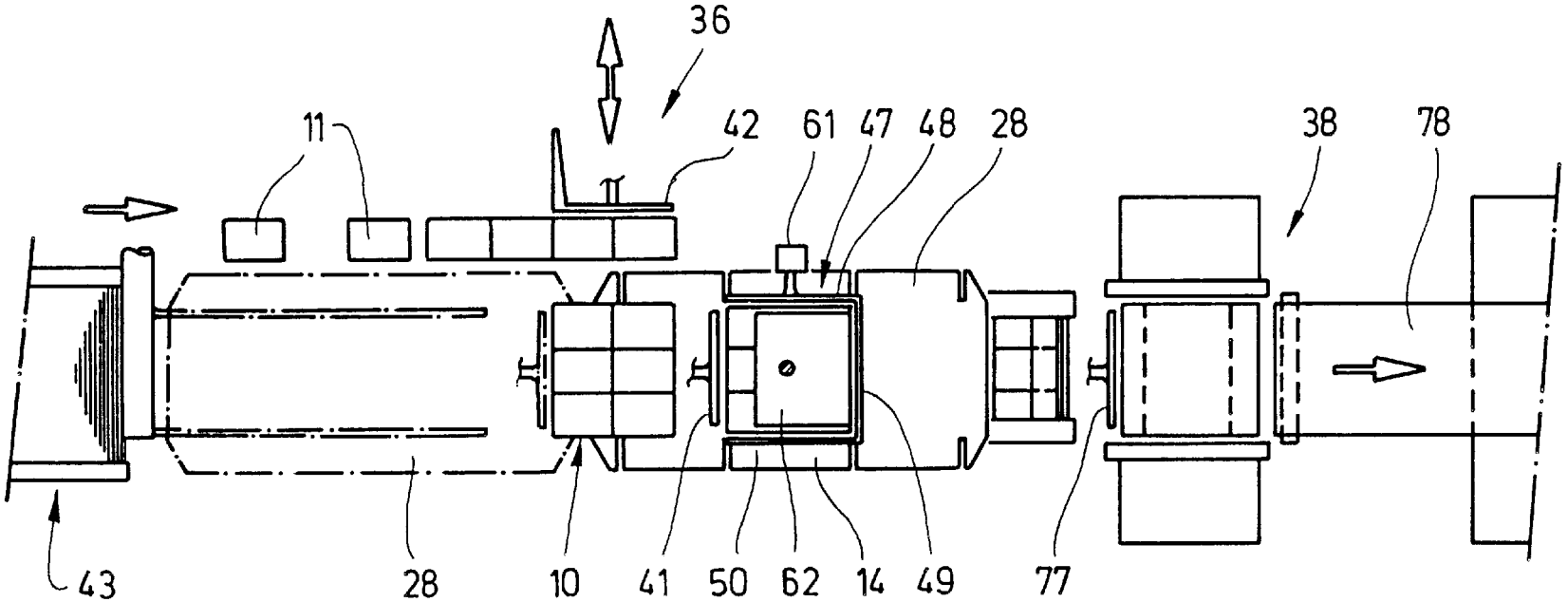
Figure 5:
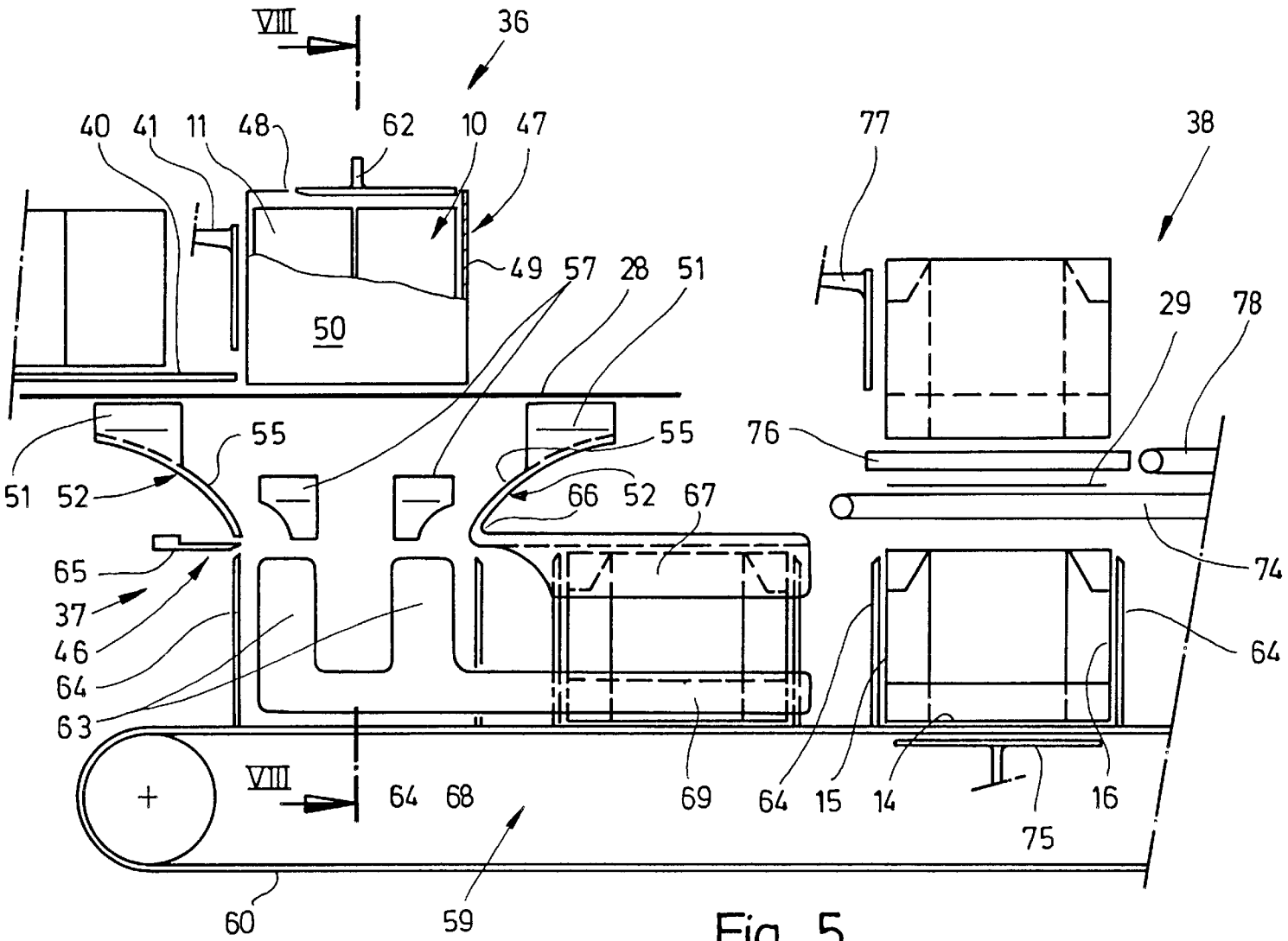
Figure 6:
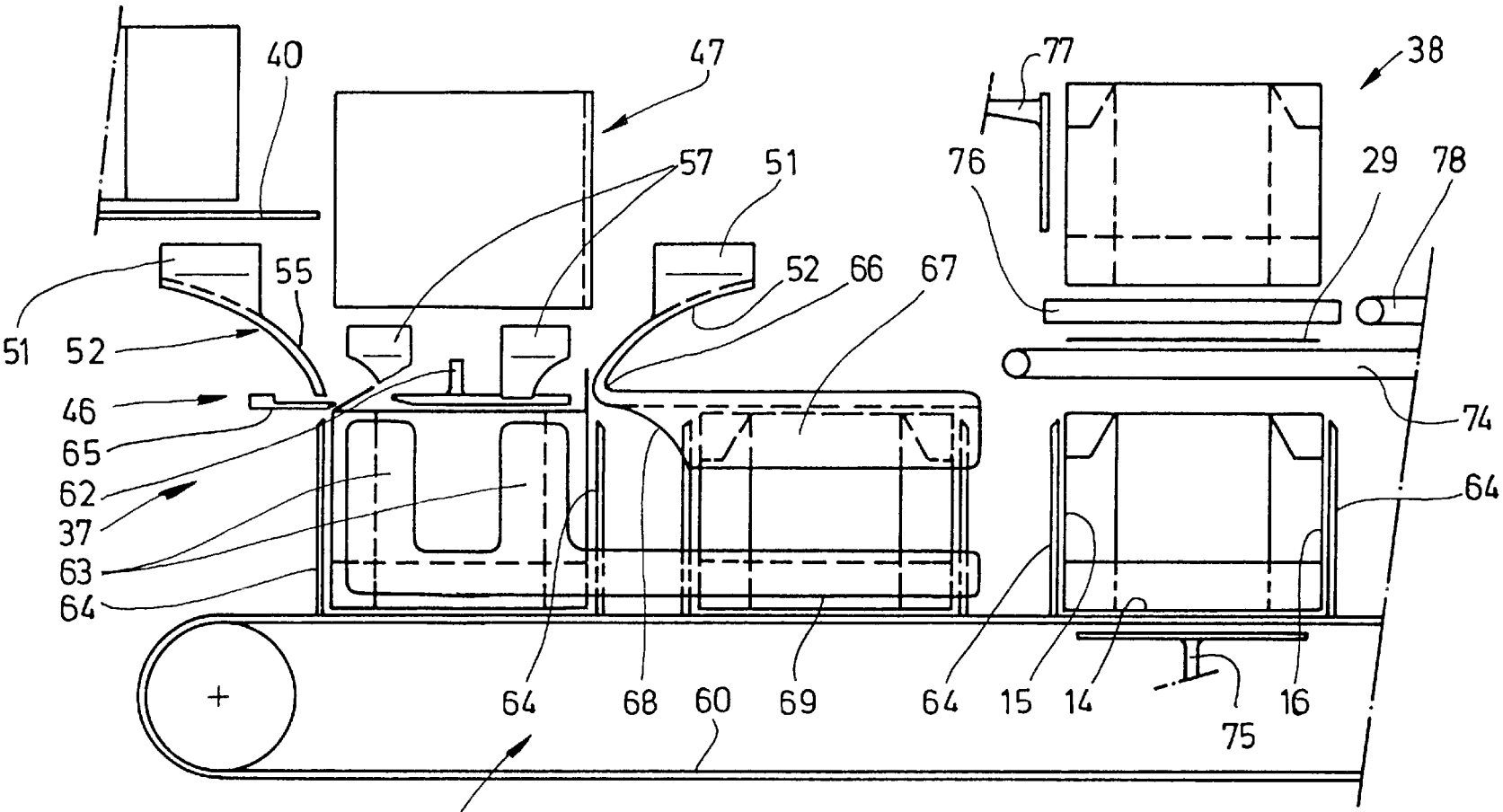
Figure 7:
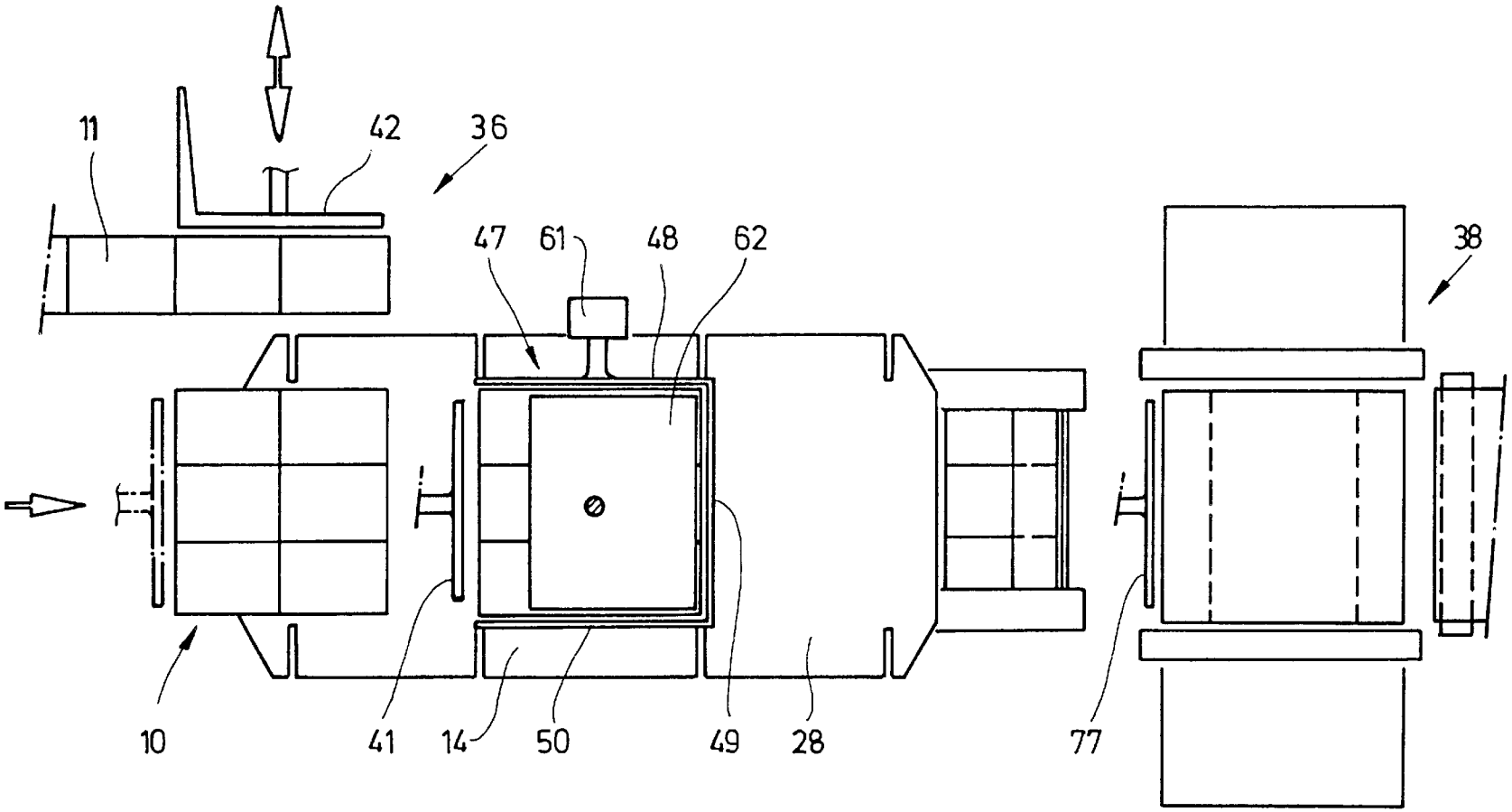
Figure 8:
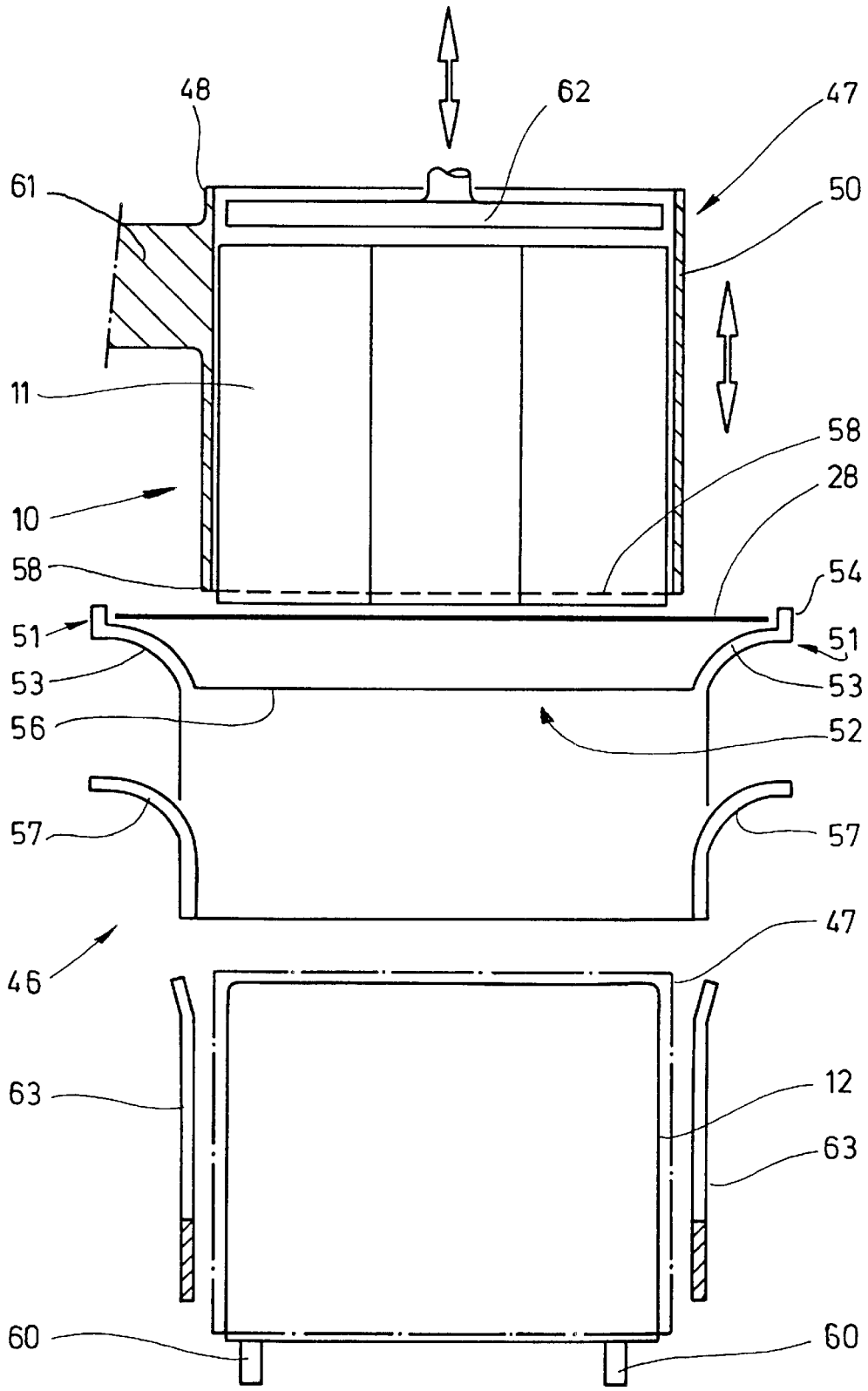
Figure 9:
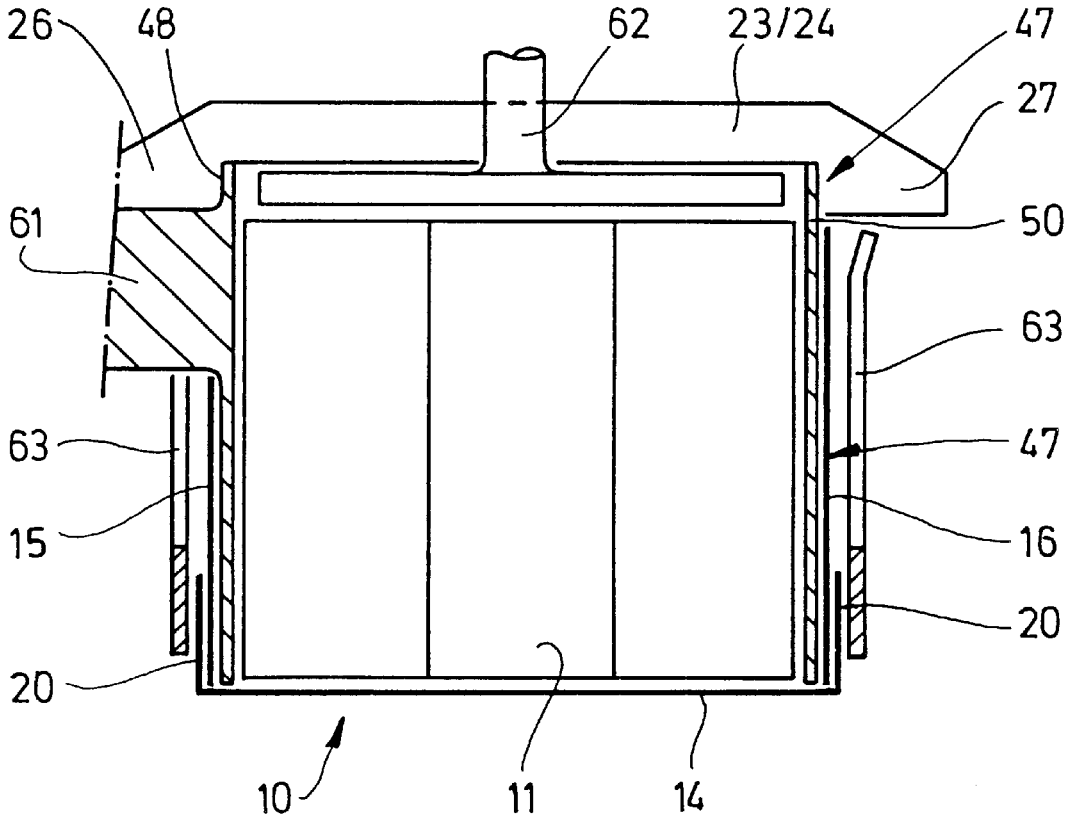
Figure 10:
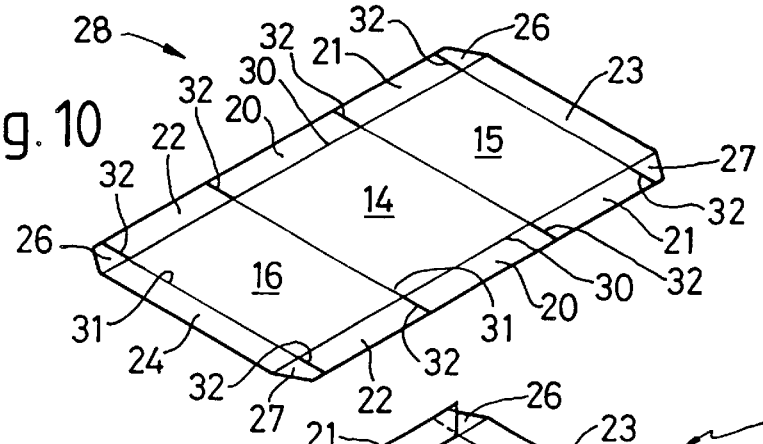

FIG. 4 shows a diagrammatic plan view of the apparatus according to FIG. 3, FIG. 5 shows a side view of a section of the apparatus with a different relative position of the individual members, FIG. 6 shows the section according to FIG. 5 in an even different relative position, FIG. 7 shows a plan view of the section according to FIG. 5, FIG. 8 shows a cross-section of a detail of the apparatus taken along the sectional plane VIII—VIII of FIG. 3 and FIG. 5, on an enlarged scale, FIG. 9 shows a further cross-section of the apparatus, also on an enlarged scale.

FIG. 10 to FIG. 14 shows a perspective view of folding steps during the erection and folding of a supporting element of the package according to FIG. 2.

FIGS. 1 and 2 show details of a novel package. This package is particularly well-suited for the accommodation of a group 10 of individual packs 11. These individual packs may be soft packs, e.g. bag-like packs with articles made of cellulose pulp or cotton wool. The individual packs 11 are combined to form an altogether cuboid group 10, in the present case in two rows.

The pack is comprised of two parts or blanks, namely a supporting element 12 and a cover 13. The supporting element 12 is configured as a partly open folding pack, especially made of cardboard. As opposed thereto, the cover 13 consists of very thin packaging material, especially of paper.

The supporting element 12 forms a bottom wall 14 and two mutually confronting, upright side walls 15, 16. The above-mentioned walls 14, 15, 16 are folded into a U-shaped position relative to one another.

Transversely relative to the bottom wall 14 and the side walls 15 and 16, open regions are formed, namely open sides 17, 18, 19 which are disposed in a U-shaped manner relative to one another. The central open side 18 at the same time forms the top side of the package opposite of the bottom wall 14.

Edge rims for the pack contents, namely bottom strips 20 in the region of the bottom wall 14, lateral strips 21, 22 and transverse strips 23, 24 in the region of the side walls 15, 16, extend in the region of the open sides 17, 18, 19, in the plane of the package surfaces. In the finished pack said strips 20 to 24 are folded into a respectively transverse position relative to the assigned walls 14, 15, 16. As a result, a part cover 25 is formed between the bottom strip 20, on the one hand, and the confronting end regions of the lateral strips 21, 22, on the other hand. In the region of this part cover 25, the respective strips are fixedly connected to one another by means of adhesive bonding. It is obvious from FIG. 2 that the bottom strips 20 adjoin the outside of the lateral strips 21, 22.

Corner tabs 26, 27 are arranged at the ends of the lateral strips 23, 24. In the ready package, these corner tabs 26, 27 are folded against the outside of the (upright) lateral strips 21, 22, and also connected thereto by adhesive bonding. As a result, an altogether stable three-dimensional supporting structure made of cardboard or the like is formed for the accommodation of the pack contents.

The cover 13 serves for covering the open surfaces of the package, specifically the lateral and upper open sides 17, 18, 19. This cover 13 is also folded in a U-shaped manner (FIG. 2) and dimensioned such that it adjoins with edge regions the outside of the bottom strips 20, lateral strips 21, 22 and transverse strips 23, 24. Here, the cover 13 is connected to the supporting element, e.g. by means of adhesive bonding.

When using the package for the first time, the cover 13 is torn off so that the pack contents are exposed and can be easily withdrawn in the case of soft packs. The cover 13 may be torn. It may, however, also be designed in such a manner that a non-destructive severing of the cover 13 from the supporting element 12 can take place, e.g. in the case of spot gluing.

The package is comprised of two one-piece, essentially rectangular blanks, specifically a cardboard blank 28 and a paper blank 29. Longitudinally and transversely directed folding lines 30, 31 define the walls and strips of the supporting element 12. The strips 20 to 24 and corner tabs 26, 27 are separated from one another by punch cuts 32. The paper blank 29 is designed in a strip-shaped manner with regions for a top wall 33 and side tabs 34, 35.

For the production and filling of a package in the embodiment described hereinabove an apparatus is suitable whose details and method of operation follow from FIGS. 3 to 9.

The apparatus comprises a collecting station 36, a cardboard folding station 37, and a paper folding station 38.

The individual packs 11 are fed to the collecting station 36 on a feed conveyor 39, if necessary, at varying distances from one another. The groups 10 are formed from a plurality of individual packs 11 on a platform 40. A slide 41, which is movable to and fro, conveys the finished group 10 into the cardboard-folding station 37. In the present embodiment (FIG. 4) two individual packs 11 are each time transversely displaced from the feed conveyor 39 onto the platform 40 by a transverse slide 42, thereby forming a group 10.

The blanks for the supporting element 12, the cardboard blanks 28, are withdrawn from a magazine 43 below the feed conveyor 39 and next to it. Within the magazine 43, the unfolded cardboard blanks 28 are positioned in an upright or slightly inclined position. One cardboard blank 28 at a time is grasped on its free side, withdrawn from the magazine 43 by means of a pivoting movement of a withdrawal member, in the present case by means of two pivotable arms 45, and transported—laterally offset—into a position below the plane of movement of the individual packs 11 by means of the two arms 45, which are spaced apart from one another and equipped with suction members 44. After having been deposited onto a blank conveyor (not shown) the cardboard blank 28 is also conveyed into the cardboard-folding station 37 and deposited above an upright folding shaft 46 in an accurately positioned manner.

The cardboard blank 28 is positioned above the folding shaft 46 in such a manner that its bottom wall 14 is aligned centrally relative to the folding shaft 46. The platform 40 for the individual packs 11 ends above the cardboard blank 28 next to the region of the bottom wall 14. The group 10, which is pushed-off from the platform 40 by the slide 41, is thereby placed directly onto the cardboard blank 28, specifically on the bottom wall 14 in a position that is suitable for the package.

The folding steps for the cardboard blank 28 which are started afterwards are effected by a downward movement of the group 10 including the cardboard blank 28 into the folding shaft 46. As a result of a movement relative to stationary folding members of the folding shaft 46, the strips 20 to 24 and the corner tabs 26, 27 are folded in the described order.

For handling soft packs, e.g. bags with cotton wool, the outer shape of the group 10 needs to be stabilized during the downward movement while taking along the cardboard blank 28. To this end, a folding sleeve 47 is provided as a supporting member which, in the present exemplary embodiment, surrounds the outside of group 10 over the entire height in a U-shaped manner. The folding sleeve 47 consequently has a rectangular or square cross-section corresponding to the geometrical shape and dimension of the group 10, and is open at the bottom, the top, and at one of the sides. In this manner, a shaping supporting structure is formed, which has upright supporting walls 48, 49, 50 which are disposed in a U-shaped manner relative to one another. The folding sleeve 47 is open on the side confronting the platform 40, so that the group 10 can be pushed into the folding sleeve 47 on this side.

For starting the folding process, the folding sleeve 47 is situated directly above the folding shaft 46 in the region of the bottom wall 14 of the cardboard blank 28. The group 10 can be pushed from the platform 40 into the folding shaft 46 which is open on one side, and positioned on the bottom wall 14.

The unit consisting of group 10 and folding sleeve 47 is jointly moved downwards out of the upper starting position shown in FIGS. 3 and 5. The cardboard blank 28 is pressed into the folding shaft 46. This folding shaft 46 is laterally limited by folding members which are configured and arranged relative to one another in such a manner that, during the downward movement of the carton blank 28, the strips 20 to 24 and the side walls 15, 16 are folded in the described order.

First, upper lateral folders 51 which extend in the longitudinal direction of the cardboard blank 28, take effect, specifically in the region of the lateral strips 21, 22, which were erected first. The first folding step thus consists in erecting these lateral strips 21, 22 transversely relative to the assigned side walls 15, 16.

Folding bodies 52 which are directed transversely relative to the longitudinal extension of the cardboard blank 28 functionally follow the lateral folders 51. These folding bodies 52 are arranged and configured in such a manner that the two side walls 15, 16 are gradually folded into an upright position relative to the bottom wall 14. It is obvious from FIG. 8 that the cross-section of lateral folders 51 is configured with an arched contour which forms a correspondingly arched folding surface 53. The lateral folders 51 also have the function of laterally guiding the cardboard blank 28 by means of upright sideboards 54. As shown in FIGS. 5 and 6, the folding bodies 52 are also designed with arched folding surfaces 55. An effective upper folding edge 56 of these folding members is downwardly offset relative to the lateral folders 51 (FIG. 8). During the further downward movement, the bottom strips 20 which are attached to the bottom wall 14 are erected, specifically by folding webs 57 which limit the folding shaft 46 in this region. As shown in FIG. 8, these folding members also have an arched shape so that during the relative movement these blank parts are gradually erected.

During the downward movement of the cardboard blank 28, the pressure to be exerted in the region of the longitudinally and transversely directed folding lines 30, 31 is created by the folding sleeve 47, specifically by the lower edges 58 thereof. These circumferentially extending edges 58 take effect exactly in the region of the folding lines 30 and 31 which surround the bottom wall 14, without deforming the individual packs 11.

In the lower position of the downwardly moved unit, the partly folded cardboard blank 28 together with the group 10 is deposited onto a conveyor track, in the present case onto a lower folding conveyor 59. This folding conveyor 59 is comprised of two conveyor chains 60 which are spaced apart from one another and on which the cardboard blank 28 rests with the bottom wall 14.

For the continuation of the folding steps, the folding sleeve 47 is then moved back into an upper starting position by a corresponding upward movement. In the present case, a stop 61, which is engaged by a lifting member, e.g. a pressure medium cylinder, is arranged on one of the supporting walls, namely the lateral supporting wall 48, in order to effect the upward and downward movements of the folding sleeve.

During the returning movement of the folding sleeve 47 into the upper starting position, a ram 62 takes effect which rests on the top side of the group 10 with a ram plate. The ram 62 is lowered synchronously with the group 10 and the folding sleeve 47 from an upper starting position (FIG. 3) into the lower position (FIG. 9). In the upward movement of the folding sleeve 47 which is started then, the ram 62 remains in the lower position for positioning the group 10 together with the cardboard blank 28 on the folding conveyor 59 and therefore to avoid an upwardly directed movement of the group 10 and/or the cardboard blank 28. Afterwards, the ram 62 is also moved back into the upper starting position.

The folding shaft 46 ends at a small distance above the group 10 when it has reached the lower position on the folding conveyor 59 (FIG. 8). In this lower position, the foldings of the cardboard blank 28 are supported by lateral guides 63, on the one hand, and by upright pocket walls 64 of pockets formed by or on the folding conveyor 59.

Further folding steps take place during the transport of the group 10 with the cardboard blank 28 through the folding conveyor 59 from the region below the folding shaft 46 to the paper-folding station 38. Before starting the discharge of the partly folded supporting element 12 together with its contents by the folding conveyor 59, a further folding step is carried out, specifically by a folding blade 65 which is movable in a horizontal plane above the pocket walls 64. The transverse strip 24 which is directed upwards in this phase is folded into the position suitable for the pack, and thus against the top side of the group 10, by means of said folding blade 65.

In the conveying movement by the folding conveyor 59, the part package or the supporting element 12 reaches the region of a transversely directed stationary folding rail 66. This folding rail 66 is located above the group 10 and serves for folding over the other, opposite transverse strip 24 into the plane above group 10 by the relative movement.

The folding rail 66 is adjoined by a stationary folding strip 67, also referred to as folding switchpoint. This folding switchpoint is provided with an arcuate, downwardly directed folding edge 68. The laterally projecting corner tabs 26 and 27 are folded by the folding strip 67 during the transport of the supporting element 12, specifically first the corner tabs 26 which are leading in the direction of transport, and then the corner tabs 27 extending on the rear side. The corner tabs 26, 27 are folded downwards against the outside of the upright lateral strips 21, 22.

During a period of the transport, the finished folding position of the supporting element 12 is fixed, specifically by a correspondingly elongate design of the folding strip 67, on the one hand, and by a supporting web 69 in the lower region of the supporting element 12, on the other hand. In this case, the supporting web 69 is connected in one piece with the upright lateral guides 63 in the region of the cardboard-folding station 37.

The finished supporting element 12 with the partly surrounded group 10 is now conveyed into the region of the paper-folding station 38 by the folding conveyor 59. In the paper-folding station 38, the blank for the cover 13 is held ready above the supporting element 12, specifically with its longitudinal extension transverse relative to the conveying direction of the folding conveyor 59. The paper blank 29 is positioned such that the central top wall 33 is exactly aligned with the open side 18 of the supporting element 12. As the result of an upward movement of the supporting element 12 together with the contents, the blank for the cover 13 is first laid against the top side, and thus against the open side 18, and then folded over on both sides in a U-shaped manner, and laid against the open sides 17 and 19. The supporting element 12 and/or the paper blank 29 are coated with glue in the region of overlap, so that a connection between supporting element 12 and cover 13 is created during this holding process.

The paper blank 29 for the cover 13 is produced by severing from a continuous web of material 71 in the region of the packaging machine. The material web 71 is drawn off a large reel 72. In the region of a severing device 73, the paper blank 29 is severed from the web of material 71 and placed onto a blank conveyor 74. This blank conveyor 74 transports the paper blank 29 into the paper-folding station 38, specifically with its longitudinal extension transverse relative to the conveying direction.

The blank conveyor 74 is comprised of two endless conveyors, especially conveyor belts, arranged at a distance from one another. The distances between these conveyor belts is chosen such that the paper blank 29 rests on the conveyor belts with the regions for forming the lateral tabs 34, 35. In this position the paper blank is held ready in an accurate relative position above the finished supporting element 12 together with the contents (FIG. 3 and FIG. 5).

The supporting element 12 is now lifted up from below by a lifting plate 75. This lifting plate 75 is dimensioned such that it can pass through the conveyor chains 60 of the folding conveyor 59 and grasp the supporting element 12 in the region of the bottom wall 14. During the upward movement, the supporting element 12 passes through the conveyor belts of the blank conveyor 74 and grasps the region of the top wall 33 of the paper blank 29 with the upper open side 18. The paper blank 29 is lifted by the blank conveyor 74 and moved through a folding tool 76 with the supporting element 12 and the group 10. The folding tool may take the form of a closed or U-shaped frame or two folding webs arranged at a distance from one another against which the paper blanks are laid during the upward movement such that the side tabs 34, 35 are folded downwardly, thereby forming the U-shape of the cover 13. The cover 13 is laid against the supporting element 12 in the position suitable for the package. Glue regions or other connecting means applied in appropriate places cause a releasable connection, if appropriate, of the cover 13 with the supporting element 12 in the region of the strips 20 to 24.

The now finished and filled package is pushed out of the paper folding station 38 by means of a pushing-off device 77, in the present case onto a discharge conveyor 78.

FIGS. 10 to 14 show the individual folding steps carried out in the production of the supporting element 12 with the help of the described apparatus.

Figure 11:
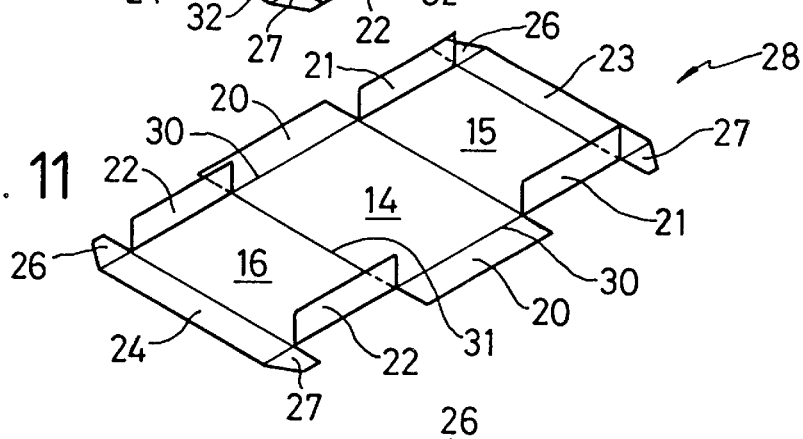
Figure 12:
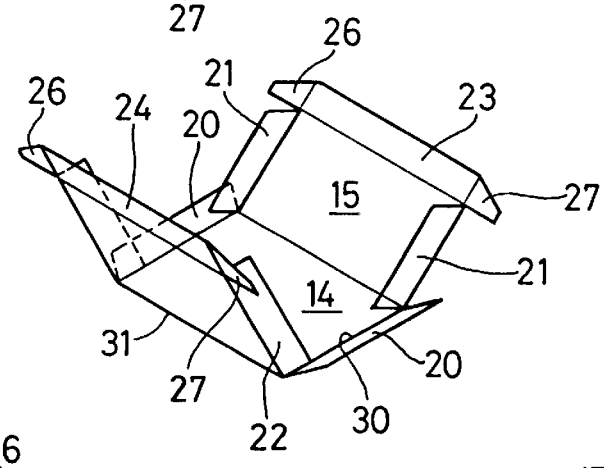
Figure 13:
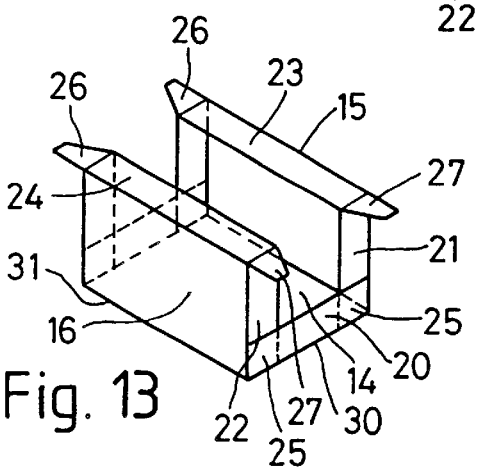
Figure 14:
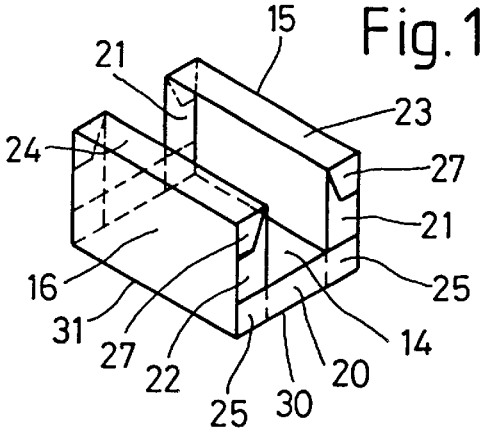

The cardboard blank 28 is prepared with longitudinally and transversely directed folding lines 30, 31, and punch cuts 32, as shown in detail in FIG. 1. In the flat, spread-out cardboard blank 28, the lateral strips 21 and 22 on mutually confronting sides of the side walls 15 and 16 are erected first (FIG. 11). Next, said side walls 15 and 16 are erected relative to the bottom wall with the folding tabs arranged thereon. The lateral strips 21, 22 stay in the folded position according to FIG. 11. The bottom strips 20 are erected with a temporal delay, so that they rest against the outsides of the now upright lateral strips 21, 22 (FIGS. 12 and 13). After this, the transverse strips 23 and 24, which are arranged on the side walls 15 and 16, are folded over inwardly from the upright plane into a horizontal position until they abut upper edges of the lateral strips 21, 22 (position according to FIG. 13). The final folding step consists in that the corner tabs 26, 27 are folded over in the downward direction until they abut the upright lateral strips 21, 22. In the regions of overlap, said folding tabs are connected to one another by means of adhesive bonding.

What is claimed is:

1. A package shipping and point of sale display system comprising:

a plurality of rectilinear packages (11) of uniform size; and a self-supporting rectilinear packing carton formed from a single carton blank for securely containing during shipment and for display the plurality of rectilinear packages (11) arranged in transversely extending parallel files that abut along a vertical parting plane, said carton comprising:

a bottom wall (14) and a pair of upright opposing side walls (15,16) joined to the bottom wall along transverse fold lines, which walls contact and support the plurality of rectilinear packages, the edges of said bottom and side walls defining a top opening and opposing end openings, each of the longitudinal edges of said bottom and side walls being joined along a fold line to a lateral strip (20, 21, 22) that projects into the end openings, said lateral and transverse strips enclosing a minor portion of the end and top openings, the lateral side wall strips being securely joined in overlapping relation to the adjacent lateral bottom wall strips, the transverse edge of the upper ends of each of the side walls being joined along a fold line to a transverse strip (23, 24) that projects into the top opening to contact the tops of the plurality of abutting packages, the ends of the transverse strips being joined along fold lines to corner tabs (26, 27), said corner tabs being securely joined in overlapping relation to the confronting ends of the adjacent lateral side strips (21, 22), to thereby form the self-supporting carton and secure the rectilinear packages in said carton, and a U-shaped paper cover (13) extending over the top and end openings and adhesively bonded to the outer surface of the lateral and transverse strips by spot gluing.

2. The carton of claim 1 where the ends of the bottom lateral strips (20) are joined in outwardly overlapping relation to the confronting ends of the adjacent lateral side wall strips (21, 22).

3. The package system of claim 1 where the lateral strips and corner tabs are joined by adhesive.

4. The package system of claim 1 in which said traverse strips (23, 24) and lateral side strips (21, 22) are of the same width.

5. The package system of claim 1 where the corner tabs (26, 27) are trapezoidal in shape and the base is equal in width to, and is formed at the fold line with the traverse strip.

6. The package system of claim 1 where the plurality of packages comprises at least ten packages arranged in equal ranks.

7. The package system of claim 1 where the carton is corrugated cardboard and the plurality of packages are formed from paperboard.

8. A method of forming a package shipping and point of sale display system that includes a self-supporting packing carton containing a plurality of rectilinear packages (11) arranged in two files that abut along a vertical parting plane, said method comprising the steps of:

(a) providing a one-piece carton blank comprised of a longitudinal web of packaging material, said web being divided by transverse and longitudinal fold lines to define a central bottom wall panel (14) positioned between a pair of side wall panels (15, 16), the dimensions of the bottom panel (14) corresponding to those of the arranged packages and the height of the side wall panels corresponding to the height of the arranged packages, the opposing longitudinal edges of each of the bottom and side wall panels being joined to a lateral strip (20, 21, 22) along a fold line, the ends of the transverse strips being joined along fold lines to corner tabs (26, 27), where the width of the lateral bottom strip is substantially less than the height of the side wall panel, and the combined width of the transverse strips (23, 24) and the combined width of the side wall lateral strips (21, 22) is each substantially less than the distance between the side wall panels (15, 16);

b) placing the plurality of rectilinear packages (11) arranged in two parallel transverse files on the bottom panel (14) of the carton blank (12);

c) folding the side wall panels (15, 16) vertically to a position contacting the packages (11);

d) folding the bottom and side wall lateral strips (20, 21, 22) and the transverse strips (23, 24) along said fold lines into overlapping contact with each other and with the packages;

e) joining the respective ends of the side wall lateral strips (21, 22) to the ends of the adjacent bottom lateral strips (20) and joining the corner tabs (26, 27) of the transverse strips (23, 24) to the ends of the adjacent side wall lateral strips to thereby form the self-supporting carton and secure said plurality of packages in the carton, f) folding a paper cover (13) into a U-shaped configuration and securing the cover to the lateral and transverse strips by spot gluing with an adhesive to cover the area of the openings between the lateral and transverse strips of the formed packing carton.

9. The method of claim 8 where the cover (13) is formed from a rectangular bank.

10. The method of claim 8 where the blank (12) is corrugated cardboard and the packages (a) are formed from rigid paperboard.

* * * * *